United States Patent [19]

Ault

[11] Patent Number: 4,768,687

[45] Date of Patent: Sep. 6, 1988

[54] RUBBER BOOT REMOVAL APPARATUS

[76] Inventor: Dwight Ault, Rt. #1 - Box 230, Austin, Minn. 55912

[21] Appl. No.: 63,813

[22] Filed: Jun. 19, 1987

[51] Int. Cl.[4] ..... A47G 25/80

[52] U.S. Cl. ..... 223/116

[58] Field of Search ..... 223/111, 113, 114, 115, 223/116, 117, 118; D6/641, 642; 36/138

[56] References Cited

U.S. PATENT DOCUMENTS

| | | | |
|---|---|---|---|
| 250,655 | 12/1881 | Gardner et al. | 223/117 X |
| 358,128 | 2/1887 | Sanford | 223/111 |
| 954,061 | 4/1910 | Von Taxis | 36/138 X |
| 4,635,833 | 1/1987 | Scarlata | 223/116 |

FOREIGN PATENT DOCUMENTS

| | | | |
|---|---|---|---|
| 140491 | 4/1903 | Fed. Rep. of Germany | 223/115 |
| 723244 | 7/1942 | Fed. Rep. of Germany | 223/111 |
| 435147 | 12/1911 | France | 223/115 |
| 419 | of 1878 | United Kingdom | 223/116 |

*Primary Examiner*—Robert R. Mackey

*Attorney, Agent, or Firm*—Douglas L. Tschida

[57] ABSTRACT

Soft rubber boot removal apparatus comprising a pair of coacting U-shaped heel grasping jaws which in one embodiment are mounted to a pair of pivoting handle members. In a floor-mounted version, a stationary jaw mounts to a tapered base plate and a movable jaw mounts to a pivotally-mounted, pedal-actuated axle member.

11 Claims, 3 Drawing Sheets

RUBBER BOOT REMOVAL APPARATUS

BACKGROUND OF THE INVENTION

The present invention relates to boot removal apparatus and, in particular, to coacting, jaw-containing apparatus for removing flexible rubber overshoes.

Over the years, a number of boot jack constructions have been developed for facilitating boot removal without the aid of an assistant and from a variety of postures, either seated or standing. Most typically, such devices include a shaped wedging member which passively projects from a base support and permits the boot wearer to lodge a relatively rigid boot heel beneath the wedged portion, while pulling one's foot from the boot as one stands on or adjacent an associated platform.

Various boot jacks of which Applicant is aware can be seen upon directing attention to U.S. Pat. Nos. 4,537,337; 3,623,640; 3,784,067; 3,526,346; 3,490,661; 2,525,174; 2,876,942; and 2,883,097. While producing the desired result of boot removal, such boot jacks are of limited assistance when used with many present day soft rubber boots or overshoes which may be rolled up and stored or inverted upon themselves during removal. Such rubber boots are commonly constructed of a uniform wall thickness rubber, without the relatively thicker heel ridge, which is commonly found in other available buckle or zipper-type overshoes, and which is engaged during removal by the hand, boot jack, etc. In spite of this deficiency, for many applications, the softer rubber boots find particular advantage and are, more often than not, daily used by farm operators, veterinarians and the like.

While in most instances boot removal can either be accomplished by way of manual extraction or with the aid of the mentioned available boot jack apparatus, without the presence of a rigid heel ledge, such boots are not easily grasped. Furthermore, where the farm operator or veterinarian has manure or other undesired substances on his boots, manual removal is not easily effected. Accordingly, a need exists for a tool whereby the boot wearer may grasp and remove such flexible boots without having to personally grasp the boot.

SUMMARY OF THE INVENTION

It is accordingly a primary object of the invention to provide a means for grasping and restraining a soft, pliable rubber boot, without damage thereto, and permit boot removal.

It is another object of the invention to provide a mechanism including a pair of coacting jaw members which may be brought to bear over a broad area at the heel of a soft rubber boot during removal.

It is another object of the invention to make available such grasping/restraining apparatus, either in a hand-operated embodiment or a foot-operated embodiment.

It is further object of the invention, with respect to its foot-operated embodiment, that an operator be permitted to maintain a normal stance, yet grasp the boot by way of applied foot pressure from the other foot.

It is still another object of the invention to provide for a variety of jaw surfaces to accommodate removal without damaging the boot.

The foregoing objects, advantages and distinctions of the subject invention are particularly achieved in a pair of alternative embodiments, one of which comprises a pliers or tong-like, hand-held removal tool and the other of which comprises a floor or base plate-mounted, pedal-actuated pair of coacting jaws. In the former pliers embodiment, the jaws are configured in a heel conforming U-shape, and the grasping surfaces are formed to grasp the boot without damaging the soft rubber.

In the floor-mounted embodiment, an axle member, including a pair of laterally disposed deals, is pivotally mounted to a tapered base plate. It includes a first jaw that extends from an extension member which, in turn, extends from the axle in overlying spring-biased pivoting relation to a second stationary jaw member, mounted to the base plate. Upon aligning a boot heel with the jaws, the opposite foot actuates its corresponding pedal to induce the jaws to grasp the boot and allow the wearer to exert an upward removal motion, without undue stress.

The foregoing objects, advantages and distinctions of the subject invention, among others, will become more apparent hereinafter upon referring to the following detailed description with respect to the appended drawings. Before referring thereto, it is to be appreciated the following description is illustrative only of presently preferred embodiments of the invention and is not intended to be all-inclusive in its description. As such, it should be interpreted within the spirit and scope of the following claims. To the extent also that modifications or improvements may have been considered, they are described as appropriate.

BRIEF DESCRIPTION OF THE PREFERRED EMBODIMENT

Figure 1:
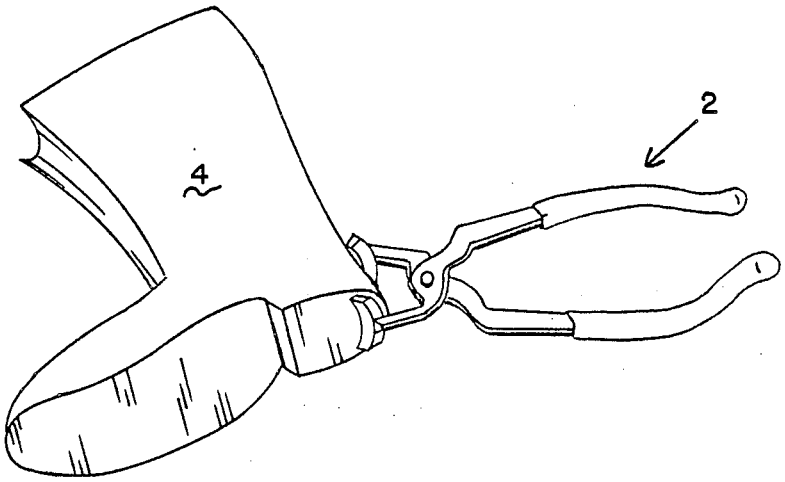
FIG. 1 shows an assembled perspective view of a boot removal pliers or tongs in mounted relation to a soft rubber boot.

Referring to FIG. 1, a generalized perspective view is shown of the invention in a pliers or tong-like embodiment 2 as it appears in its typical application when removing a molded soft rubber or neoprene overshoe 4. Such overshoes 4 are manufactured by a variety of manufacturers under a number of brand names, for example, Totes, Tingley Rubber Corp., etc.

Whereas conventional thicker rubber overshoes have a hardened or pronounced heel or surrounding ledge which facilitates boot removal by engaging same with the toe of the opposite foot or boot jack, the present overshoes 4 have soft pliable heels. That is, where a relatively stiff boot, having a pronounced heel portion is used, upon drawing the heel into contact with the passive jaw of a boot jack, the wearer may raise his/her foot relative to the restrained overshoe and effectuate boot removal. In contrast, the more compliant overshoes are not easily restrained by way of a passive wedging action, since the boot material is not rigid enough to retain its shape and provide a counter-removal pressure. Instead, most such attempts to restrain the boot merely induce greater friction between the boot and the wearer's undershoe, which may induce tearing of the boot.

Removal is accordingly most effectively achieved by physically grasping the heel of the boot with the hand and drawing the boot 4 from the wearer's foot. While the later method is relatively simple in application, it is to be appreciated that in many instances where the boots are used under muddy or farm conditions, it is preferable to have some type of aid for removal, as opposed to using one's hands.

Appreciating the foregoing problem and with attention to FIG. 1, the present, surrogate boot removal tool was developed and which in FIG. 1 comprises a pliers-like tongs 2 which may be clamped about the boot's heel as the operator applies hand pressure to draw the boot 4 off of the undershoe. Contact is thereby avoided with the boot 4 itself and a more positive, non-slip gripping action is obtained by way of the pliers' jaws.

Figure 2:
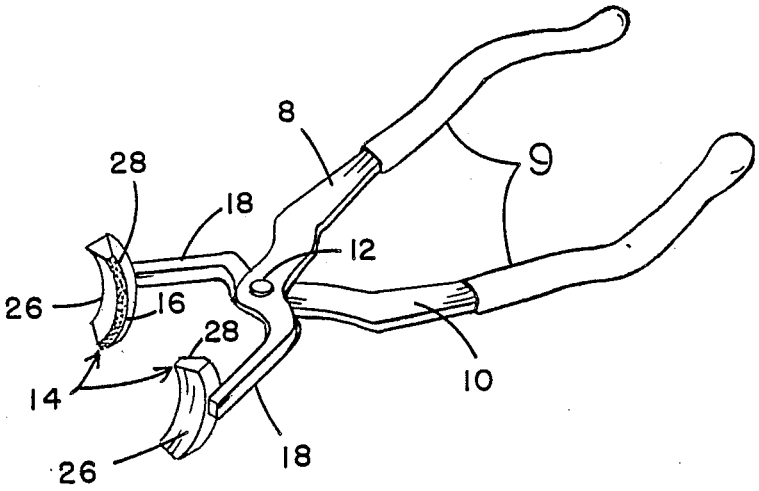
FIG. 2 shows a detailed perspective view of the tongs of FIG. 1.

With continuing attention to FIG. 1 and additional attention directed to FIG. 2, a perspective view is shown of the pliers 2 and which generally comprises a pair of pivotally mounted, coacting lever arms 8 and 10 which are mounted to each other via a pivot pin 12 to rotate upon the grasping of the hand grips 14 and induce the end-mounted, U-shaped jaws 14 to grasp an intermediately positioned boot. The gripping surface 16 of each jaw is machined to facilitate a non-slip grasping of the boot 4, without damaging the boot, as by abrading or puncturing the back or bottom of the boot heel.

As depicted, it is to be noted the hand grip portion of each lever arm 8 and 10 is formed with a slight outward bend, which relative to the shape of the forward neck portion 18, enables the jaws 14 to separate a sufficient amount to easily grasp the boot heel, yet be sufficiently separated when the jaws are closed so that the fingers of the gripping hand are not so close to one another to be uncomfortable or minimize the gripping action.

A conventional vinyl dip coating 9 is applied over the ends of the lever arms to enable slip-free grasping; although, it is to be appreciated the lever arms 8 and 10 might be cast or otherwise molded with a variety of hand grip configurations, including individual finger relief indentations, such as in a pistol grip, or with multiple or single finger loops. Additionally, one may choose to include a latch mechanism whereby upon squeezing the lever arms a sufficient distance, a latch mechanism may be set, so that the user is free to adjust his/her hand position to facilitate boot removal, without having to continuously squeeze the lever arms 8 and 10. One of such latch assemblies might comprise a pair of overlapping serrated projections which overlap one another at a defined point of closure. Alternatively, some type of finger-engageable hoop or arm may be similarly positioned to capture the opposing lever arm, upon sufficiently closing the jaws.

Figure 3:
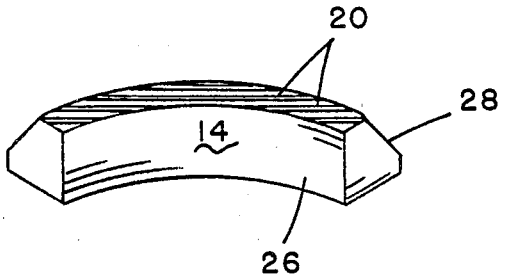
FIG. 3 shows a perspective view of the jaw of one of the tong members and an elongated grasping pattern formed in the outer jaw surface.
Figure 4:
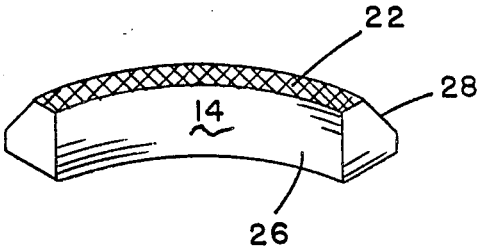
FIG. 4 discloses a view of a jaw having knurled grasping pattern.
Figure 5:
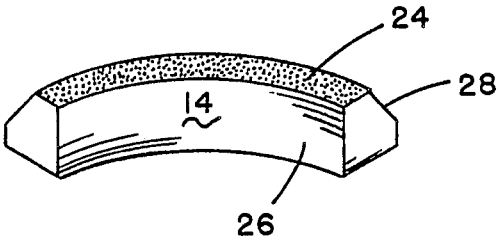
FIG. 5 discloses a view of a granular surfaced jaw.

With particular attention next directed to the configuration of the jaws 14 and with additional attention to FIGS. 3, 4 and 5, it is to be appreciated the jaws are generally formed with a U-shape so as to mount about and contact a relatively broad area of the boot heel during removal. The gripping surface 16, as can be seen from FIGS. 3 through 5, is appropriately machined to slightly deform the rubber in the area of the jaws to provide a cooperating interaction and a non-slip grip. In that regard, FIG. 3 discloses an embodiment wherein a number of parallel serrations 20 are provided over the lateral jaw surface. FIG. 4 depicts more of a knurled gripping surface 22 wherein a number of closely spaced protrusions are provided. To prevent damage to the rubber of each protrusion, the points are machined off or molded with a slight rounding. FIG. 5, in turn, discloses an embodiment wherein an abrasive material 24, such as sandpaper or the like, is bonded to the jaw surface.

In combination, the foregoing U-shaped jaw configuration and jaw surfaces displace the gripping force over a relatively large surface area to prevent tearing the boot upon removal. While conceivably a conventional pliers might be employed, it is to be appreciated the gripping force would be obtained over a very narrow space which, upon pulling on the handles, can easily tear the boot. In contrast, the present U-shaped jaws, by contacting a substantial portion of the heel, top and bottom, maximizes the grasping surface and minimizes the operator's ability to twist the tongs 2 and a boot 4, thus limiting the removal force to a straight line, non-tearing, pulling force.

From FIGS. 2 through 5, it is to be further appreciated the jaws 14 are formed such that a generally vertical flat surface 26 is providedat the fore end of the jaw, with a horizontal grasping band of approximately $\frac{1}{4}$ to $\frac{3}{8}$ inch and a tapered trailing edge 28. The taper 28 enables the operator to vary the applied direction of the removal force and follow the foot by bending the tongs 2 back or forth as the boot is removed. Without this relief, the pulling motion would be restricted, not to mention possibly damaging the boot at the uppermost jaw line with induced bunching of the boot material. By relieving the inner jaw surface, however, the tongs 2 may follow the natural arc of the boot and foot as it is removed, while continuously applying a straight line oppositely-directed removal force thereover.

Figure 6:
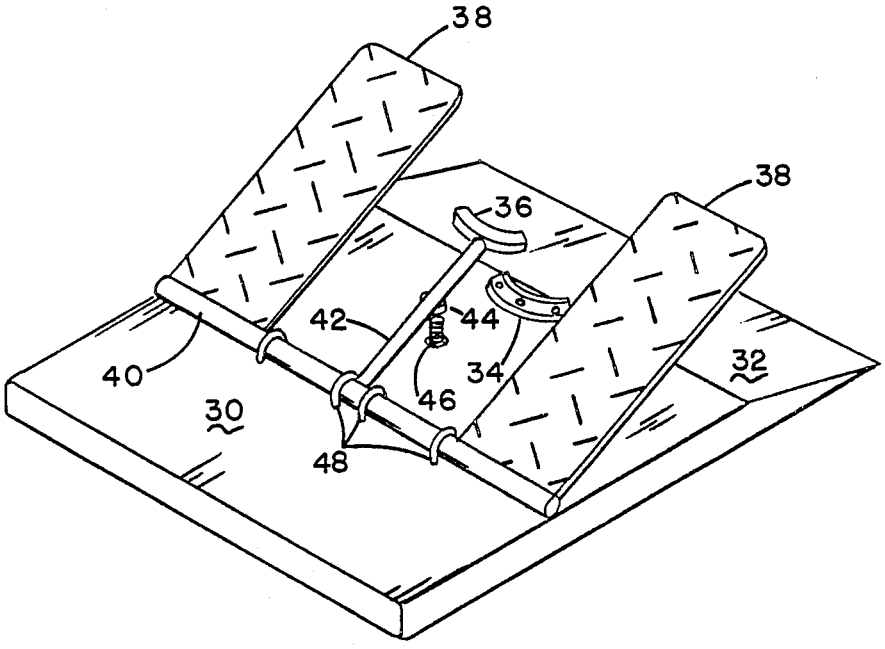
FIG. 6 discloses a perspective view of a pedal-operated boot removal device.

Appreciating further the difficulties of removing a boot from a seated posture, FIG. 6 depicts a floor-mounted alternative embodiment of the invention wherein a positive gripping action is similarly obtained as in the embodiments of FIGS. 1 and 2, but from a more comfortable upright posture. In operation, a user stands over this embodiment and grips the boot heel in the provided jaw members as pressure is applied thereto via the other foot, upon pushing down on one of a pair of the laterally displaced pedals. The boot is thereby restrained in a fashion more like that of conventional boot jacks, however, utilizing a pair of coacting jaws, in lieu of a passive, pinching restraint. The operator is also better positioned to apply greater leverage by way of his/her leg muscles, without concern for jaw slippage, since the opposite foot and operator's weight maintains the gripping action.

Referring now to the detailed construction of the embodiment of FIG. 6, it generally comprises a platform member 30 having a tapered forward edge 32 upon which a user may rest the heel of his/her boot at an inclined angle relative to the bottom stationary jaw 34 and overlying active jaw 36. Depending upon whether the right or left boot is being removed, either the right or left pedal weldment 38 is stepped on. This action, via the interconnecting pivot arm 40 and upper jaw containing extension member 42, induces the upper jaw 36 to rotate and grasp the boot, as before.

Mounted midway along the bottom surface of the extension arm 42 is a cupped disk member 44 which receives a spirally-wound spring 46 projecting from the base member. In addition to containing the spring 46, the disk 44, because it is slightly taller than the jaw 34, limits the travel of the upper jaw to prevent against over pressure. A predetermined jaw spacing and travel accommodating of boot insertion and removal is thereby obtained. In lieu of a spirally-wound spring 46, it is to be appreciated a leaf spring member might be equally employed.

While too the pivot arm 40 is restrained via a number of U-shaped staples 48, it is to be appreciated that pillow block supports, or similar bearing assemblies, might be employed equally well. Still further, the upper jaw 36 might be modified by rearwardly relieving the otherwise vertical boot contacting surface 26 and/or possibly removing the ramp 32 from the base member 30, either of which provide the wearer with a greater freedom of motion during removal, without the above-mentioned bunching and possibility of tearing or damage to the back of the boot during removal.

While the subject invention has been described with respect to presently preferred alternative embodiments and a number of modifications thereto, it is to be appreciated that still other modifications may be suggested to those of skill in the art without departing from the spirit and scope of the invention. It is accordingly contemplated that the following claims should be interpreted to include all those equivalent embodiments within the spirit and scope thereof.

What I claim is:

1. Boot removal apparatus comprising:

(a) a base member;

(b) a stationary U-shaped heel conforming jaw mounted to said base member;

(c) first and second pedal members coupled to a second movable U-shaped jaw member mounted in overlying relation to said first jaw member;

(d) means for pivotally coupling said second jaw member to said base member such that foot pressure to one of said first and second pedals induces the grasping of a shoe on the other foot between said first and second jaw members.

2. Apparatus as set forth in claim 1 wherein said base member in the area of said stationary jaw member is tapered.

3. Apparatus as set forth in claim 1 wherein said first and second pedal members are coupled to a lateral axle pivotally mounted to said base member and said second jaw member is coupled to said axle.

4. Apparatus as set forth in claim 1 including means for resiliently biasing said second jaw member away from said stationary member and including means for limiting the closure of said jaw members relative to one another.

5. Footwear removal apparatus comprising:

(a) a foot-supporting base member;

(b) a first stationary heel-conforming jaw having a horizontal gripping surface mounted to said base member;

(c) a second heel-conforming jaw having a horizontal gripping surface overlapping the gripping surface of said first jaw; and (d) foot-actuated means including an elongated member supporting said second jaw and a pivot member transversely mounted to said elongated support member and means for securing said pivot member to said base member for pivoting said second jaw to compressively grasp the heel of footwear placed on said first jaw between the horizontal gripping surfaces of said first and second jaws.

6. Footwear removal apparatus comprising:

(a) a foot-supporting base member having an inclined ramp portion;

(b) a first stationary heel-conforming jaw having a horizontal gripping surface mounted to said ramp portion;

(c) a second heel-conforming jaw having a horizontal gripping surface; and (d) foot pedal means including an axle member mounted to said base member for pivoting said second jaw into overlapping engagement with said first jaw to grasp the heel of footwear placed on said first jaw between the horizontal gripping surfaces of said first and second jaws.

7. Footwear removal apparatus comprising:

(a) a foot-supporting base member having an inclined ramp portion;

(b) a first stationary jaw including a U-shaped horizontal gripping surface mounted to said ramp portion;

(c) a second jaw having a U-shaped horizontal gripping surface mounted to a foot pedal having an axle pivotally secured to said base member, such that upon depressing said foot pedal said second jaw pivots to grasp the heel of footwear placed on said first jaw between the horizontal gripping surfaces of said first and second jaws.

8. Footwear removal apparatus comprising:

(a) a foot-supporting base member having an inclined ramp portion;

(b) a stationary jaw having a U-shaped horizontal gripping surface mounted to an upper end of said ramp portion;

(c) a second jaw having a U-shaped horizontal gripping surface mounted to an elongated support member having a laterally extending axle pivotally secured to said base member and suspended in overlying relation to said first jaw;

(d) a spring mounted to said base member and biasing said second jaw away from said first jaw; and (e) at least one foot pedal mounted to said axle to pivot the horizontal gripping surface of said second jaw into overlapping engagement with said first jaw to grasp the heel of footwear placed on the horizontal gripping surface of said first jaw.

9. Apparatus as set forth in claim 8 wherein the gripping surface of each of said first and second jaws includes a plurality of parallel lateral grooves.

10. Apparatus as set forth in claim 8 wherein the gripping surface of each of said jaws is covered with a granular abrasive material.

11. Apparatus as set forth in claim 8 wherein the gripping surface of each of said jaws is knurled.

* * * * *